United States Patent [19]

Kriegel et al.

[11] Patent Number: 5,062,599

[45] Date of Patent: Nov. 5, 1991

[54] SHEET SEPARATING MECHANISM AND APPARATUS FOR USE THEREIN

[75] Inventors: Jon M. Kriegel, Rochester; Richard E. Albrecht, Honeoye Falls, both of N.Y.

[73] Assignee: Eastman Kodak Company, Rochester, N.Y.

[21] Appl. No.: 495,512

[22] Filed: Mar. 19, 1990

[51] Int. Cl.[5] ..... B65H 3/52

[52] U.S. Cl. ..... 271/35; 271/121; 271/123

[58] Field of Search ..... 271/3, 4, 10, 35, 34, 271/123, 121, 124, 125, 301, 65, 185, 186, 163; 355/319, 318

[56] References Cited

U.S. PATENT DOCUMENTS

| | | | |
|---|---|---|---|
| 408,209 | 8/1889 | Burnet | 271/123 |
| 4,327,904 | 5/1982 | Holmes | 271/121 |
| 4,477,176 | 10/1984 | Russel | 271/186 X |
| 4,844,435 | 7/1989 | Giannetti et al. | 271/35 X |
| 4,934,685 | 6/1990 | Shifley | 271/35 |

*Primary Examiner*—David H. Bollinger
*Attorney, Agent, or Firm*—Leonard W. Treash

[57] ABSTRACT

A scuff sheet separating mechanism includes a device for gripping the rear portion of a stack of sheets, not including the one being fed, and pulling the portion gripped away from a sheet separating nip until the sheet is fed. The device includes a pair of fingers which are periodically closed and then laterally reciprocated to grip the stack and pull it away from the nip and move it back into position to separate another sheet. This mechanism is particularly useful in the intermediate tray of a copier or similar apparatus to prevent toner on one side of the sheet being fed from scraping off onto an adjoining sheet because of the force between a scuff device and a feed mechanism.

13 Claims, 3 Drawing Sheets

SHEET SEPARATING MECHANISM AND APPARATUS FOR USE THEREIN

BACKGROUND OF THE INVENTION

1. Field of the Invention

This invention relates to sheet separating mechanisms. It is especially useful with sheet separating mechanisms that separate the bottom sheet from a stack of sheets that have freshly fixed toner images on their topsides.

2. Description of the Prior Art

Many commercial copiers use an intermediate tray, sometimes called a duplex tray, for receiving copy sheets that have had one image transferred and fixed to them. These sheets are later fed out of the intermediate tray to receive a second image as properly controlled by a logic and control unit in the copier. This intermediate tray can be used to make duplex copies and to make color copies. In the duplex case, the opposite sides of the sheet receive the images, whereas with two-color copies the same side of the sheet receives two images. Duplex two-color copies can be made by feeding the sheet through the intermediate tray three times.

Sheets fed out of the intermediate tray are generally separated from the bottom of the stack. Separating from the bottom is a difficult task. As a result, vacuum rollers have been used for that purpose because of their reliability. However, vacuum rollers are expensive in both power and equipment and may increase the noise output of the copier. Scuff feeding devices are much quieter and less expensive, but have a tendency to be less reliable.

Typical scuff sheet separating devices include a belt or roller which engage the bottom sheet in a stack and feed it along a path. A scuff separating pad or roller is mounted on the opposite side of the path and prevents a second sheet from being fed. In the classic scuff separating device, the coefficient of friction of the belt or roller which is feeding the bottom sheet is higher than that of the scuff separating pad or roller which in turn is higher than the friction between the sheets. Thus, the bottom sheet slides on the next sheet while the next sheet is held by the scuff pad. When only one sheet is left in the stack, that sheet slides on the scuff pad.

U.S. Pat. No. 4,844,435 to Giannetti et al., issued July 4, 1989, describes a scuff separating device which feeds document sheets from the bottom of a stack using a retard roller which is braked. The brake on the retard roller prevents rotation of the roller when more than one sheet is in the nip, but is overcome and permits rotation when one or no sheets are in the nip. This structure is extremely reliable in preventing double feeds and permitting the passage of a single sheet in highly demanding document feeding applications.

Each of the above scuff separating devices rely for separation on a certain amount of force of the scuff separating pad or roller on the top of the second sheet. Unfortunately, in a duplex mode, the top of the first sheet has a freshly fixed toner image, which includes particles of toner that can be disturbed in response to rubbing. With scuff feeding devices of each of the types described, the leading millimeter or so of the bottom of the second sheet is vigorously rubbed by the entire top surface of the bottom sheet. Unless the image on the top surface of the bottom sheet is extremely well fixed, toner will rub off on the front portion of the bottom of the second sheet creating a toner mark across that edge of the sheet and smudging the image on the bottom sheet.

SUMMARY OF THE INVENTION

It is the object of the invention to provide a scuff separating device which reduces or eliminates the problem described.

This and other objects are accomplished by a scuff sheet separating mechanism which includes a means for receiving a stack of sheets in a position in which the stack (and each sheet) has a leading end and a trailing end. A sheet retard means and a sheet separating means form a nip into which a leading end of an outside sheet of the stack is fed. To reduce or eliminate the above problem the mechanism is provided with means for gripping the trailing end of the portion of the stack other than said outside sheet after said outside sheet has been moved toward or into the nip and for moving the stack in a direction away from the nip. This gripping and moving means reduces the effect of the nip forcing the sheet adjacent the outside sheet against the outside sheet, thereby reducing or eliminating the rubbing action on the leading portion of the second sheet.

DETAILED DESCRIPTION OF THE PREFERRED EMBODIMENT

Figure 1:
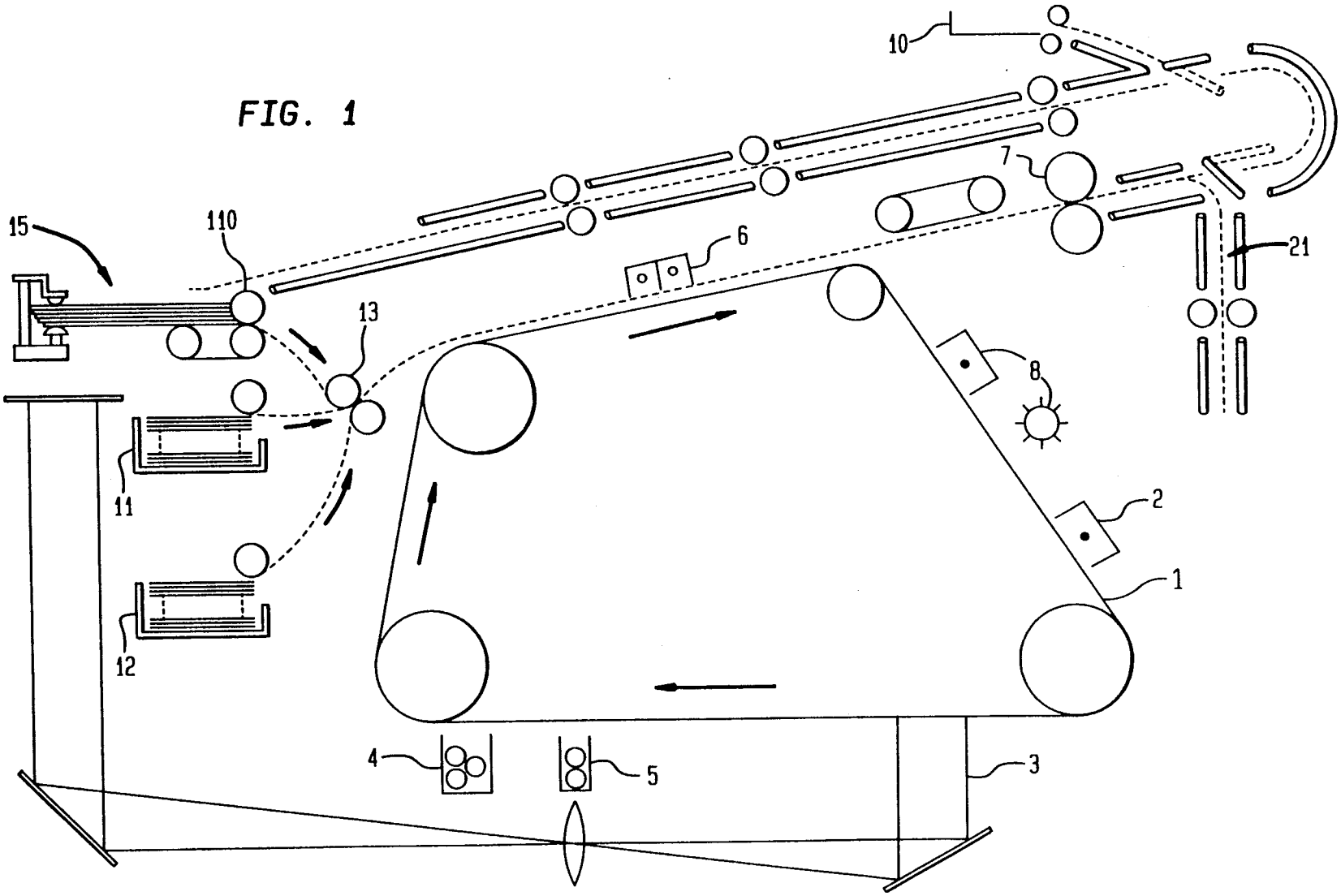
FIG. 1 is a schematic side view of a reproduction apparatus in which the invention is particularly useful.

According to FIG. 1 a known electrophotographic apparatus, e.g., a copier, includes an image member, e.g., an electrophotographic web 1, which moves through a series of electrophotographic stations well known in the art. Image member 1 is first charged by a charging station 2, exposed at an exposure station 3 to an optical image to create an electrostatic image. The electrostatic image is toned at one of the toner stations 4 or 5 to create a toner image defined by the electrostatic image. The toner image is transferred to a receiving sheet at a transfer station 6 and is fed to a fuser 7 where it is fixed. The receiving sheet may then be moved to an output tray 10. The image member 1 is cleaned at a cleaning station 8 and reused.

Fresh receiving sheets are stored in first supply 11 or second supply 12. An appropriate size receiving sheet can be fed from either supply to transfer station 6 through a pair of timing rollers 13. If duplex copies are to be made, the receiving sheet is fed from the fuser 7 through an inverting path to an intermediate tray 15. This deposits the receiving sheets in tray 15 with the image side up. If a number of copies are to be made of the two images (or of different images in an automatic pre-collation mode) a substantial stack, for example, 100 sheets, can be accumulated in intermediate tray 15. When the second side is to be imaged, the receiving sheets are fed from intermediate tray 15 from the bottom of the stack to timing rollers 13 for presentation of the bottom side of the sheet to imaging member 1 at transfer station 6 to pick up the image for the opposite side. The sheet is then fed to output tray 10 with images on both sides.

If images of two different colors are to be placed on the same side of the receiving sheet, the receiving sheet receives the first image at transfer station 6 and is fused at fusing station 7 as before. However, this receiving sheet is fed first through a turnaround device 21 before following the same inverting path as the preceding sheet back to intermediate tray 15. Turnaround device 21 assures that the path from transfer station 6 back to intermediate tray 15 is a non-inverting path and, therefore, the image is on the bottom of the sheets in intermediate tray 15. When all the first color images have been transferred and the receiving sheets are stacked in intermediate tray 15, the sheets are then fed from the bottom of the stack through timing rollers 13, as before, to transfer station 6 to receive the images of the different color to be added to the bottom side of the sheets. The sheets may then be fed to the output tray with two color images on one side. With proper control of the imaging apparatus, two color images can be formed on both sides of the sheet without use of turnaround 21 by doing one color on each side and then the other color on each side.

Toning station 4 is shown somewhat larger than toning station 5. In high volume copiers and duplicators it is conventional for the black toning station to be larger than the toning station containing an accent color, for example, red.

Continuous off-the-bottom feeding out of intermediate tray 15 of receiving sheets with freshly fused images must be carefully done. Freshly fused images are easily smudged or rubbed off onto other sheets, and feeding from the bottom without double feeds is technically challenging. Scuff feeding devices are the least expensive of all feeding devices and also use the least power and create the least noise. However, they have the greatest tendency to damage the sheets and smudge or scrape off the images. A scuff separating device shown in FIG. 2 creates a substantial improvement in scuff separating devices, per se, as well as in separating devices useful in intermediate trays. It is based on a scuff separating device that is the subject of U.S. Pat. No. 4,844,435 mentioned above.

Figure 2:
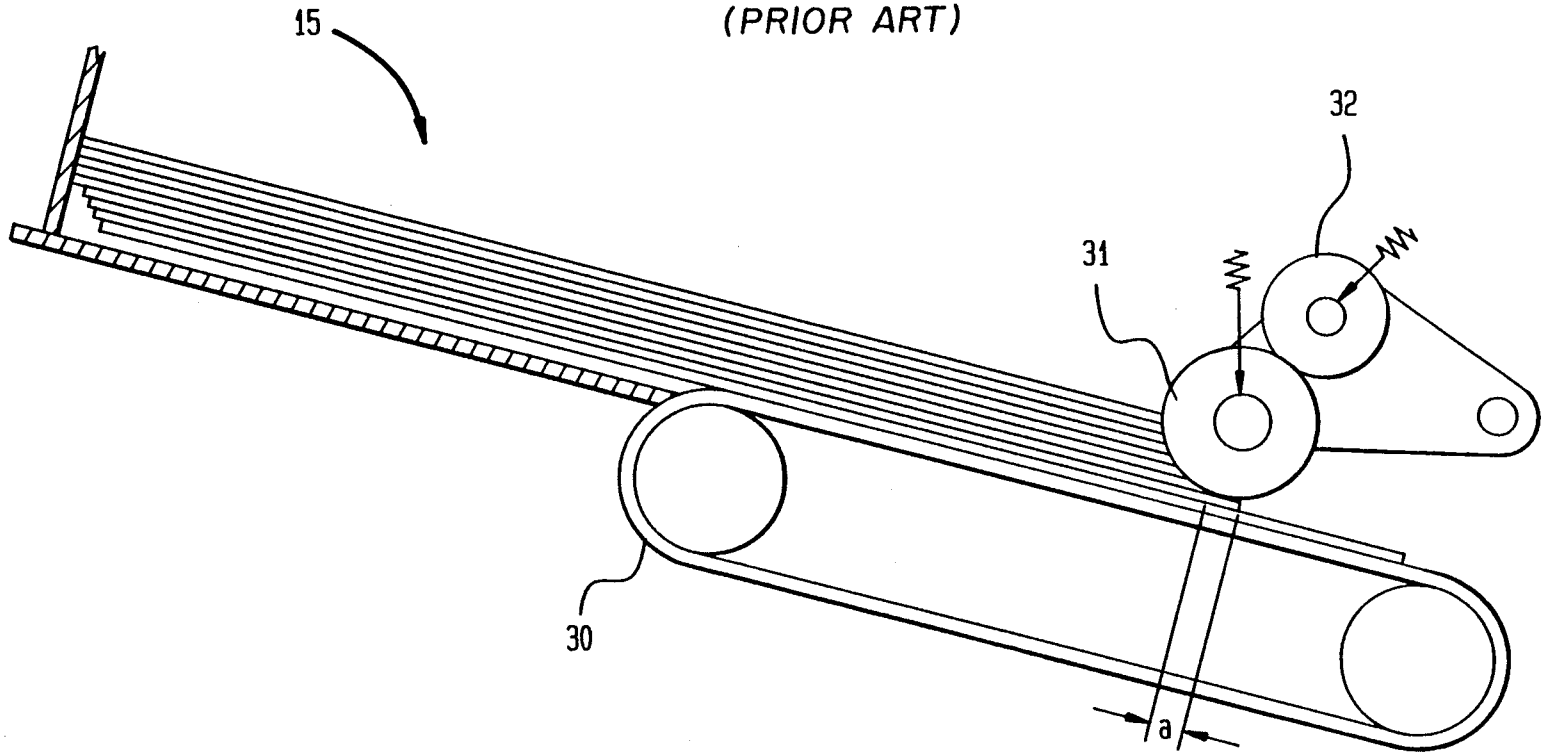
FIG. 2 (PRIOR ART)
FIG. 2 is a side view illustrating the problem encountered when applying prior scuff sheet separating mechanisms to the apparatus of FIG. 1.

FIG. 2 illustrates both the operation of such a scuff separating device and the problem toward which this invention is directed. According to FIG. 2, an intermediate tray 15 constitutes a means for receiving a stack of sheets in a position in which the stack has a leading end and a trailing end. The leading end of the stack and of each sheet is the end to the right in FIG. 2. A sheet separating means, e.g., a feed or separating belt 30 engages the bottom sheet of the received stack, then feeds the leading end of the bottom sheet into a nip that belt 30 forms with a retard roller 31. Both belt 30 and retard roller 31 have high friction external surfaces and retard roller 31 rotates as the first sheet is fed through the nip. However, retard roller 31 is braked by a brake roller 32 which engages the periphery of retard roller 31. The friction between retard roller 31 and the sheets is greater than the friction between the sheets. The force exerted by brake roller 32 on retard roller 31 is chosen to permit retard roller 31 to roll with a single sheet. However, it is sufficient to stop the roller 31 when a second sheet enters the nip, permitting the first sheet to slide on the second sheet and be fed alone. As with all scuff separating devices, operation is dependent upon substantial friction between the retard roller 31 and the second sheet. This friction is, of course, a function of the coefficient of friction of the retard roller and the weight, spring force or the like that urges the retard roller into the top sheet.

We have found that the amount of force required on the sheets in the nip to assure separation is more than enough to rub not completely fixed toner off the top of the bottom sheet onto the leading edge of the bottom of the second sheet. This shows up as a black (or other color) line across the leading edge of the bottom of the second sheet that is wedged in the nip. The width of the line is denoted as "a" in FIG. 2. Such a line is not acceptable in modern-day copiers or printers. Further, the image on the top of the first sheet often is smudged.

Figure 3:
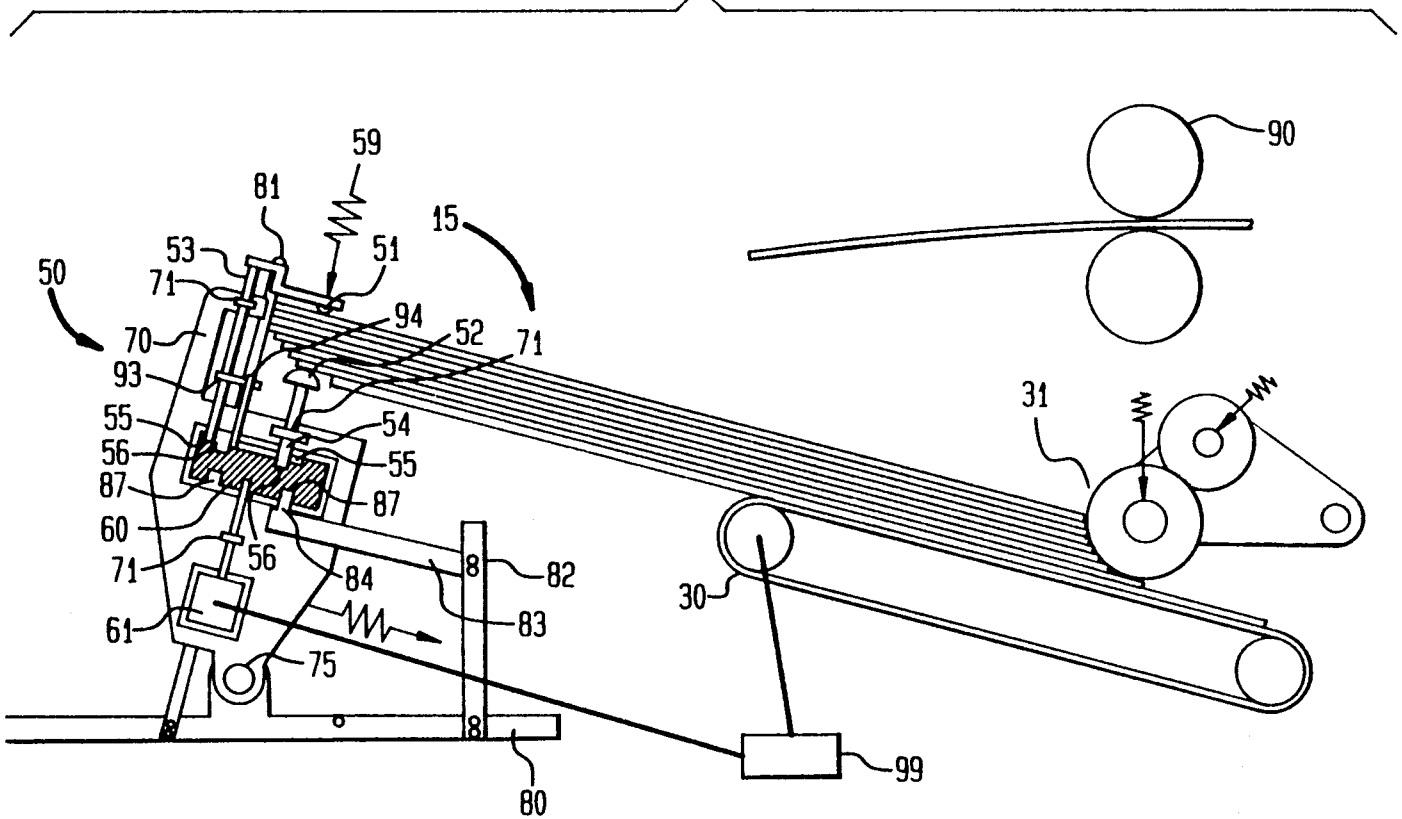
FIG. 3 is a side view with portions schematic and eliminated for clarity of illustration of an apparatus similar to that of FIG. 2, but incorporating the invention.

This problem is solved by a mechanism shown in FIG. 3. According to FIG. 3, a stack control mechanism 50 grips the trailing end of the portion of the stack other than the bottom sheet after the bottom sheet has been moved slightly toward or into the nip and moves the stack in a direction away from the nip to prevent the retard roller 31 from vigorously rubbing the leading end of the second sheet on the image-bearing top of the bottom sheet.

Stack control mechanism 50 includes means for engaging the trailing portion of the top of the stack, for example, a top finger 51 and means for engaging the trailing portion of the bottom of the stack, for example, a bottom finger 52. Top finger 51 is connected to a top finger control pin 53 and bottom finger 52 is connected to a bottom finger control pin 54. Control pin 53 is moved up and down by a top finger control cam 55, and control pin 54 is moved up and down by a bottom finger control cam 56. Control cams 55 and 56 are formed in the top surface of a cam plate 60 which is connected to and rotated by a motor 61.

As cam 60 is rotated, fingers 51 and 52 move together to grip a stack then part to release it. As shown in FIG. 3, cam 55 is at the bottom of its contour as it engages pin 53 thereby permitting a spring 59 to lower finger 51 against the top of the stack. At the same time, cam 56 is at the top of its contour and is pushing pin 54 upward to force finger 52 into the bottom of the stack. Thus, as shown in FIG. 3, the fingers 51 and 52 are gripping the rear portion of all sheets of the stack except the bottom sheet which is being fed.

The cam plate 60 and motor 61 as well as pins 53 and 63 are supported by a support plate 70 through suitable support projections and bushings 71. Support plate 70 is pivotally connected by a pivot 75 to a support frame 80 which is movable generally parallel to the feed path of the sheets to control the position of a back plate 81 against which incoming sheets abut. Back plate 81 is adjustable to permit intermediate tray 15 to receive sheets of different length in the feed direction.

Support frame 80 is connected to a vertical arm 82 which supports a support arm 83 having a lateral control pin 84 projecting from its top. Control pin 84 is a cam rider which rides in a lateral control cam 87 formed in the bottom surface of cam plate 60. As cam plate 60 is rotated by motor 61 lateral control pin 84 forces cam plate 60 to move to the left and the right as shown in FIG. 3. This movement of cam 60 moves the entire support plate 70 around pivot 75. It also moves gripping fingers 51 and 52 to the left and to the right to move the stack toward and away from the nip.

In operation, a logic and control mechanism 99 begins the movement of belt 30 through a motor (not shown). As belt 30 begins to move, it frictionally carries with it the bottom sheet into the nip between belt 30 and retard roller 31. The second sheet is carried by the first sheet into the nip where it is stopped by the retard roller 31 as the bottom sheet begins to slide on the second sheet. At this point, motor 61 begins to run as controlled by logic and control 99 to rotate cam plate 60. Cam plate 60 rotates to the position shown in FIG. 3 in which fingers 51 and 52 first move into gripping relation with the rear end of the stack and the support plate 70 is moved to the left to pull the stack away from the nip. By the time the fingers 51 and 52 grip the rear end of the stack, the bottom sheet is out of the way of bottom finger 52 and can continue to be driven while the rest of the stack is pulled to the left.

As the trailing edge of the bottom sheet begins to leave the nip, the cam plate 60 reaches a point at which cam 87 causes fingers 51 and 52 to move to the right to push the stack back toward the nip so that the second sheet which has now become the bottom sheet can enter the nip and be separated. As the cam plate 60 continues to rotate, cams 55 and 56 reach portions of their contour which cause fingers 51 and 52 to separate, thereby releasing their grip on the rear portion of the stack and permitting the bottom sheet (formerly the second sheet) to be separated.

With this structure, the second sheet spends a very small portion of time in the nip with the bottom sheet rubbing against it before it is pulled out of the nip until the bottom sheet has passed. I have found it possible to successfully grip the rear $\frac{1}{8}$ to $\frac{1}{4}$ inch of the second sheet and the rest of the stack with fingers 51 and 52 and reliably move the stack. This means that only a small portion of the top of the bottom sheet rubs against the bottom of the second sheet before the second sheet is pulled out of the nip. Generally, this is a portion of a sheet that does not have toner. However, even if it does have toner, this small a portion being rubbed is a substantial improvement over rubbing the entire sheet. I have found that this structure substantially cures the problem.

Although preferable, it is not necessary that the stack be pushed by the fingers 51 and 52 back into the nip. The stack can be released by fingers 51 and 52 allowing the belt 30 to bring the sheets into the nip.

According to FIG. 3 a pair of feed rollers 90 are shown which are the last rollers in the duplex path feeding sheets into the duplex tray 15. With high productivity machines, sheets will be fed into the duplex tray while belt 30 is feeding sheets out. Finger 51 can be in the way of properly stacking incoming sheets. It is possible to feed sheets under finger 51 when it is in its raised position in response to a high contour on cam 55. However, a more reliable structure includes a retraction arm 93 which is rigidly connected to pin 53 and which is rotated by a retraction pin 94 protruding from cam plate 60. Thus, as cam plate 60 rotates, pin 94 engages arm 93 to rotate pin 53 thereby swinging finger 51 around pin 53 and away from a position over the stack permitting sheets that had been received on top of finger 51 to take a position on top of the stack. Arm 93 is spring urged against a stop (not shown) when not engaged by pin 94. (Retraction pin 94 is shown approaching its engaging position in FIG. 3 for purposes of illustration only. At the position of the other elements in FIG. 3, pin 94 would, in fact, be on the opposite side of cam plate 60.)

Support frame 80 supports the entire mechanism 50 so that it can be used with different length sheets. Support frame 80 also supports rear abutment member 81 which, consistent with prior intermediate trays, is adjustable for different length of sheets.

Motor 61 can be operated directly by logic and control 99. However, in a more simple and reliable mechanism it is timed directly off belt 30. Timing of motor 61 by either approach is well within the skill of the art..

The problem solved by this invention was the result of rubbing of toner off the top of a bottom sheet being separated from a stack. However, it is clear the invention has wider application. Any separation situation in which it is desirable to lessen rubbing between sheets may find the invention applicable. Note also that reliability of the separation operation is increased because a double feed is positively prevented for more than 97% of the movement of the bottom sheet in contact with the second sheet.

The invention has been described in detail with particular reference to a presently preferred embodiment, but it will be understood that variations and modifications can be effected within the spirit and scope of the invention.

We claim:

1. A sheet separating mechanism comprising:

means for receiving a stack of sheets in a position in which the sheets and the stack have leading ends and trailing ends, sheet retard means, sheet separating means forming a nip with the sheet retard means, for engaging an outside sheet of a received stack and feeding a leading end of said sheet into said nip, and gripping and moving means for gripping the trailing end of the portion of said stack other than said outside sheet after said outside sheet has been moved toward or into said nip and for moving said stack in a direction away from said nip to reduce the force of the nip forcing the sheet adjacent said outside sheet against the outside sheet.

2. A sheet separating mechanism according to claim 1 wherein said gripping and moving means includes:

first means for engaging the trailing portion of the top of the stack, second means for engaging the trailing portion of the bottom of the stack, means for moving said engaging means together to grip said stack, and means for moving said engaging means away from said nip to move said stack away from said nip.

3. A sheet separating mechanism according to claim 2 wherein said means for moving said engaging means away from said nip includes means for moving said stack back toward said nip and said means for moving said engaging means together includes means for separating said engaging means to release said stack.

4. The sheet separating mechanism according to claim 2 wherein said means for moving said engaging means includes a rotatable cam plate having a first cam surface for controlling the movement of said first engaging means and a second cam surface for controlling the movement of said second engaging means and means for rotating said cam plate.

5. A sheet separating mechanism according to claim 2 including:

means for moving said first engaging means to a position permitting the addition of sheets to said stack.

6. A sheet separating mechanism according to claim 1 wherein said sheet separating means is positioned to engage and feed the bottom sheet of a received stack.

7. Sheet separating mechanism according to claim 6 wherein said sheet separating means is a separating belt.

8. Sheet separating mechanism according to claim 1 wherein said retard means is a braked retard roller which roller is braked with enough braking force to prevent turning of said roller when two sheets are in said nip forcing one sheet to slide on the other, but with sufficient braking force to prevent turning of said roller when one sheet is being fed through the nip.

9. The sheet separating mechanism according to claim 8 wherein said separating means is a separating belt which engages and feeds the bottom sheet of a stack through said nip.

10. A reproduction apparatus which includes a sheet separating mechanism constructed according to claim 1.

11. A reproduction apparatus according to claim 10 which apparatus further includes:

means for forming a unfixed toner image on an image member, means for transferring said unfixed toner image to a receiving sheet, means for fixing said unfixed toner image to said receiving sheet, means for feeding said receiving sheet from said fixing means to said sheet separating mechanism, and means for feeding said receiving sheet from said sheet separating mechanism back to said transfer means to receive another toner image thereon.

12. A reproduction apparatus according to claim 11 wherein said means for feeding receiving sheets from said device to said transfer means presents the side of said sheet opposite to the side having the fixed toner image to said transfer station for receiving said another image.

13. A reproduction apparatus according to claim 11 wherein said sheet separating means is positioned to engage and feed the bottom sheet of a received stack.

* * * * *